United States Patent [19]

Brest van Kempen

[11] 4,352,600

[45] Oct. 5, 1982

[54] DEVICE AND METHOD FOR CONTROLLING TIME DEPENDENT PARAMETER VARIABILITY

[76] Inventor: Carel J. H. Brest van Kempen, 4920 Emigration Canyon, Salt Lake City, Utah 84104

[21] Appl. No.: 144,987

[22] Filed: Apr. 30, 1980

[51] Int. Cl.[3] ..... E21D 21/00

[52] U.S. Cl. ..... 405/259; 73/784; 73/818

[58] Field of Search ..... 405/259–262; 173/1, 4, 12, 20; 73/783, 781, 818, 784, 785, 761; 408/3, 10, 16

[56] References Cited

U.S. PATENT DOCUMENTS

| | | | |
|---|---|---|---|
| 2,398,392 | 4/1946 | Page | 173/12 |
| 2,873,629 | 2/1959 | Frautschi | 408/3 |
| 2,973,067 | 2/1961 | Eddy | 172/12 X |
| 3,246,544 | 4/1966 | Cooper | 408/10 |
| 3,362,266 | 1/1968 | Krafft | 408/10 |
| 3,387,669 | 6/1968 | Wise et al. | 173/20 X |
| 3,538,755 | 11/1970 | De la Cruz | 73/783 |
| 3,563,087 | 2/1971 | Brunelle et al. | 73/761 |
| 3,572,447 | 3/1971 | Pauley et al. | 173/20 X |
| 3,645,341 | 2/1972 | Amtsberg | 173/12 |
| 3,659,655 | 5/1972 | Cjuongyosi | 173/4 X |
| 3,667,345 | 1/1972 | Schaedler | 173/12 |
| 3,693,726 | 9/1972 | Hornig et al. | 73/761 X |
| 3,768,573 | 10/1973 | Jennings | 173/12 |
| 3,956,926 | 5/1976 | Phillips | 73/785 X |
| 3,992,928 | 11/1976 | Thoms | 73/784 |
| 4,136,556 | 1/1979 | Graham | 73/784 X |

OTHER PUBLICATIONS

U.S. Bureau of Mines Report of Investigations No. 6646—J. H. Stears.

*Primary Examiner*—Dennis L. Taylor
*Attorney, Agent, or Firm*—K. S. Cornaby

[57] ABSTRACT

A method for controlling parametric variations in processes where one variable is subject to an exponential change with time. One application is particularly advantageous in underground mine roof bolting using mechanical anchors where a device utilizing the method can be employed to install mine roof bolts at varying initial tensions in such a manner that the bolt tensions found among a population of roof bolts converge to one tension value within one or two hours after installation due to individual differences in tension decay rate. Since roof bolt tension decay bears an exponential relationship to time, variability in bolt tension which develops after mentioned convergence has taken place is small for a long period of time, in marked contrast to a conventional installation which is characterized by bolt tension variability which grows rapidly into a far wider range immediately after installation. An extension of said mine roof bolting application further allows an exact assessment of mine roof movements using the roof bolts themselves. A device embodying the invention in mine roof bolting as described, senses the roof bolt tension decay rate during the installation process and automatically tensions the roof bolt to a value appropriate to achieve tension convergence as described.

7 Claims, 9 Drawing Figures

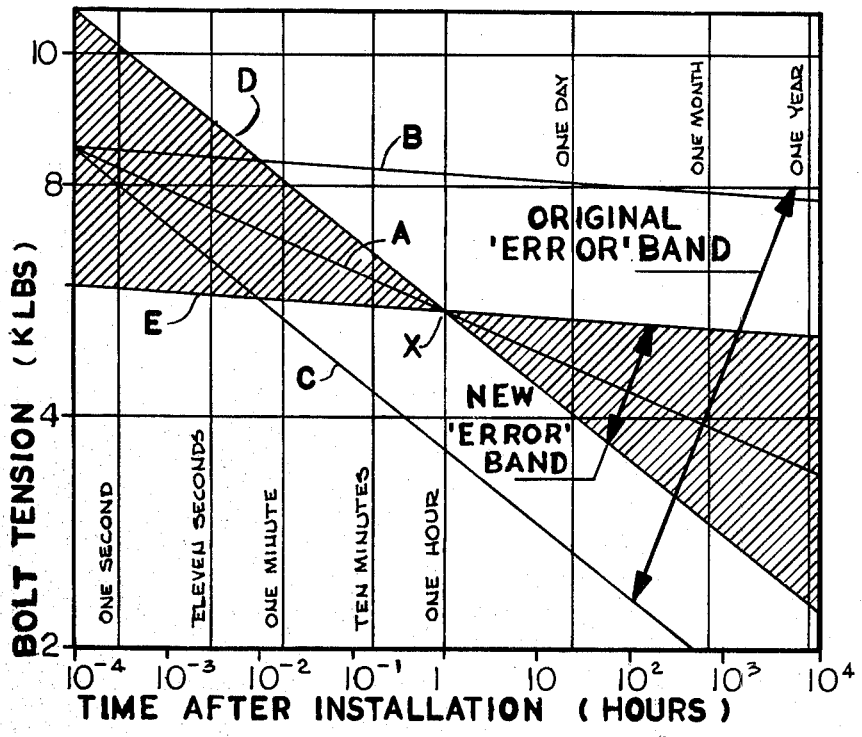
FIG. 1
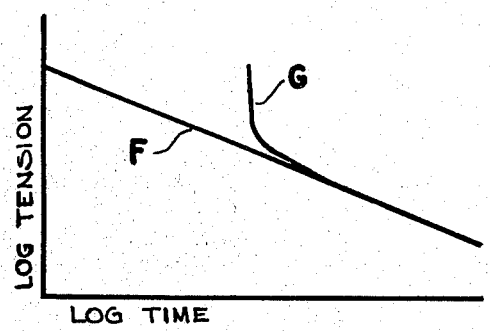
FIG. 4
FIG. 5
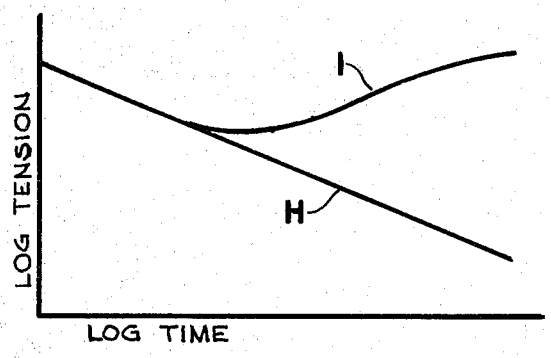

DEVICE AND METHOD FOR CONTROLLING TIME DEPENDENT PARAMETER VARIABILITY

BACKGROUND OF THE INVENTION

This application is related to my co-pending application, Ser. No. 144,991 filed Apr. 30, 1980, now U.S. Pat. No. 4,300,397.

This invention relates to the field of roof tension bolts used in underground mines, and was developed to circumvent a disadvantage which is widely experienced in the application of mechanically anchored roof bolts in underground mining.

It is noted that roof bolting is used as the primary means of roof support in underground mines using the room and pillar mining method, which comprises 90% of U.S. coal mined underground. Typically, four to six foot deep holes are drilled vertically in the overlying rock strata. These holes are normally 1 to 1⅜ inch in diameter and spaced on a four foot square grid. Steel rock bolts, or roof bolts, are inserted in these holes and either grouted in the hole for essentially their full length or provided with an expanding anchor at the upper end. A roof plate and bolt head are provided at the lower end.

In the latter case, the bolt is normally tensioned to one half of the yield strength of the bolt, as provided in the Code of Federal Regulations, Title 30, Part 75.200. The tensioned connection thus formed between the rock which houses the anchor and the roof surface at the other end of the bolt renders the roof structure much more competent and self supporting. The disadvantage in practice is that the tension in the roof bolt, which is established at the time of installation, gradually decays with time. The rate of bolt tension decay is frequently highly variable from bolt to bolt, so that a population of bolts initially installed with perfectly uniform tension frequently displays a tension variability characterized by a standard deviation of 20% of the mean instantaneous bolt tension within a very few hours after installation. For example, a population of bolts which are all installed with a tension of 7000 lbs. may within one hour after installation include bolts on which the tension has decayed to 3000 lbs., as well as bolts which still retain 6500 lbs. tension and a variety of intermediate tension values. The example cited is typical and the associated bolt tension variability which thus grows with time, materially detracts from the quality of the roof support and hence from safety in the mine. To date no method or means has been available or known to deal with the basic problem just described.

This invention is accordingly directed to a novel method and novel means for reducing the time dependent variability in roof bolt tension.

A principal object of the invention is to provide a practical and convenient method and means of decreasing time dependent variability of bolt tension in a population of roof bolts, where the gradual loss of bolt tension is unavoidable in itself. An additional object of the invention is to achieve a substantial reduction in bolt tension variability with time in a population of roof bolts, using a modification and augmentation of the equipment means already in use to drill the roof bolt hole and tension the roof bolt.

A further object of the invention is to create a method for monitoring the behavior of the roof in a particular section of a mine by monitoring deviations from established bolt tension decay rates, since such deviations are indicative of movements of the mine roof.

SUMMARY OF THE INVENTION

A method for decreasing variability in tension on underground mine roof bolts according to the invention, includes the step of determining the tension decay characteristic and tightening the bolt to a final tension shortly after installation of the roof bolt as determined by the foregoing tension at longer intervals following installation the method also allows determination of magnitude and location of bed separations in roof rock strata.

The apparatus for implementing the method described above includes means for coordinating and controlling in concert the following means: means for sensing roof bolt head torque; means for maintaining the roof bolt head torque-roof bolt tension relationship; means for determining roof bolt tension decay rate; means for determining desired final roof bolt tension as determined from previously measured roof bolt tension decay rate to obtain convergence in time of bolt tension values in a population of roof bolts.

BRIEF DESCRIPTION OF THE DRAWINGS

FIG. 1 is a graphical representation of the relationship between bolt tension and time, showing various typical bolt tension decay FIG. 2, a vertical cross section of a typical rock bolt installation in an underground mine roof;

FIG. 4, a graphical representation of the effect of delaying installation of a roof bolt by a discrete amount of time;

FIG. 5, a graphical representation of the effect of bed separations in mine roof strata on roof bolt tension superimposed on a normal bolt tension decay pattern;

DESCRIPTION OF THE PREFERRED EMBODIMENTS

Figure 2:
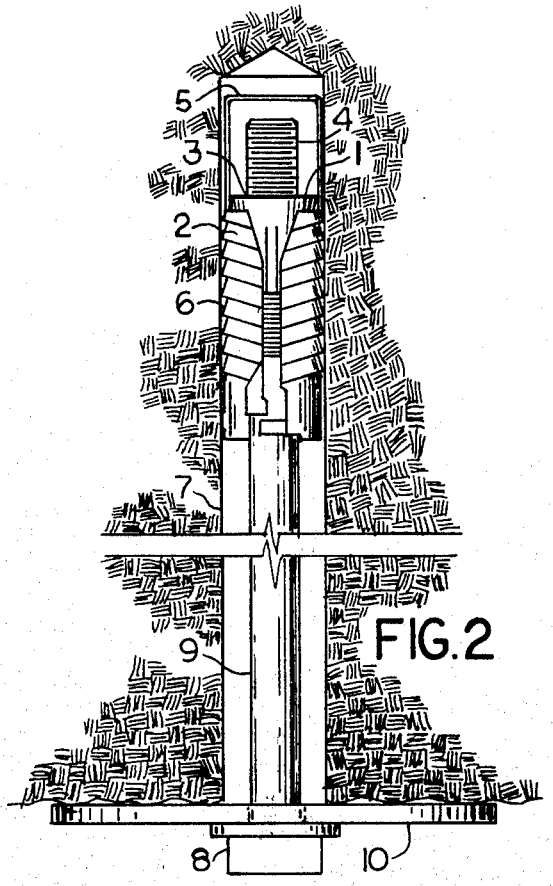

The anchor at the upper end of a typical mechanical roof bolt consists of a tapered steel plug 1, as shown in FIG. 2, and a set of two or four tapered steel leaves 2. Plug 1 is provided with a threaded aperture 3 into which the threaded end of a bolt 4 is inserted. Leaves 2 may be provided with a bail 5, which serves the dual purpose of holding leaves 2 together prior to installation and also of providing the impetus of pushing plug 1 down into leaves 2 during the initial phase of the installation process. Leaves 2 are normally provided with a number of teeth 6 which bite into the rock surface 7 of a bolt cavity. One of these teeth is shown in detail in FIG. 3. The teeth serve the purpose of increasing the effective coefficient of friction between rock surface 7 and anchor leaves 2, as well as providing a safety margin in holding capacity during times when contact between rock surface 7 and anchor leaves 2 might be briefly interrupted. The latter interruption may for example particularly occur when explosive blasting is conducted in the vicinity of the rock bolt installation.

Figure 3:
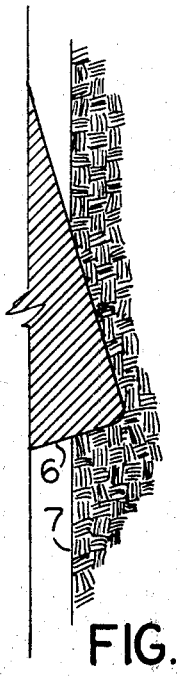
FIG. 3, a detailed view of one of the teeth of an anchor leaf shown in FIG. 2.

FIG. 3 shows that as a tooth 6 is forced into the rock, failed rock mass has to be displaced to make room for the tooth. The rapid tooth movement into the rock which is forced by the bolt tensioning process during bolt installation, comes to rest at a point where the stress on the rock surface contacting the anchor tooth is equal to or even higher than the unconfined compressive strength of the rock. When material, including rock, is stressed to a value equal to or greater than its compressive strength, relatively rapid creep ensures. The actual rate of creep is dependent on the nature of the material as well as on the magnitude of the stress. Since, in the case of a roof bolt, the absolute value of the stress at the anchor tooth/rock interface at the time of installation is only dependent on the compressive strength of the rock immediately surrounding the anchor, the rate of initial creep is therefore dependent on the nature of the rock.

As teeth 6 creep further into the rock, anchor leaves 2 open more widely and allow tapered plug 1 to move down slightly, thus relieving some of the tension stored in bolt 4. The creeping movement of the anchor teeth into the rock is thus the single most important cause of tension loss in the roof bolt. The exact rate at which tension in the roof bolt is lost is seen to be a functon of properties of the rock immediately surrounding the anchor, the geometry of the anchor, and length of the roof bolt. In actual practice, tension loss progresses at a rate which decays exponentially with time, because as the roof bolt loses tension, the available load per anchor tooth decreases, thus decreasing the stress on the rock/anchor tooth contact surface. The contact surface also increases in area as the anchor tooth creeps into the rock, futher reducing the contact surface stress. These combined factors are seen to reduce the creep rate and hence the rate at which bolt tension is lost, thus producing the exponential decay in tension loss as already described.

If the logarithm of bolt tension is plotted against the logarithm of time, a straight line is obtained, shown as A in FIG. 1. A close approximation to actual practice is obtained if the installation is assumed to take place at the time indicated by $10^{-4}$ hours (which is equal to 0.36 second) on the time scale in FIG. 1. The slope of the straight line as described is then a function primarily of the three factors noted above. Of these three factors, the length of the roof bolt and the anchor geometry are normally held constant in a particular roof support plan. The remaining third factor, the nature of the rock immediately surrounding the anchor, is variable from bolt to bolt and cannot be controlled. The variability of this third factor, then, typically causes a bolt tension decay pattern within a population of roof bolts which is distributed in the area defined between lines B and C in FIG. 1. As shown in FIG. 1, the variability in bolt tension in a population of roof bolts increases with time.

The discovery that tension decay always proceeds along a straight line on a logarithmic scale, such as shown in FIG. 1, (subject to additional factors to be discussed later), can be advantageously combined with a second discovery. Since the slope of the tension decay curve as defined in FIG. 1 is fixed by the nature of the rock surrounding the anchor, for a particular roof bolt in a particular location, changing the initially installed tension does not change the slope of the tension decay curve; i.e. a change in initial tension shifts the tension decay curve in parallel fashion. Combining discoveries, a procedure has been developed to shift initial bolt tension in reliance on the slope of the tension decay curve.

If curve B in FIG. 1 is shifted by installing the corresponding roof bolt at an appropriately lower initial tension, curve E is produced. If curve C in FIG. 1 is shifted by installing the corresponding roof bolt at an appropriately higher tension, curve D is produced. A procedure can be adopted to dramatically decrease the time dependent variability in bolt tension among a population of roof bolts, especially over the time range of the greatest interest in underground mining; i.e, from one hour to one month after installation. The initial bolt tension is adjusted according to the tension decay rate exhibited by each bolt. A typical change in error band, i.e., the tension range encompassing a particular population of roof bolts achieved by this procedure, is indicated in FIG. 1 by the shaded areas. The variability in bolt tension among a population of bolts is greater during the first few minutes after installation using this procedure. This initial increase in variability is of little practical significance, however, especially in view of the fact that it typically may take up to two hours to install a set of about twenty roof bolts. It should be noted that the time difference in installation of individual bolts does not materially change the benefits.

FIG. 4 illustrates the relative insignificance of installation time lags from one bolt to the next. In FIG. 4, the bolt tension decay curve of a particular bolt is depicted as indicated by the label F. The bolt tension decay curve for the same bolt is shown on the same scale and with the same initial bolt tension, but installed two hours later, as indicated by the label G. The two curves still converge.

The actual point of nominal convergence, indicated by X in FIG. 1, may be made to occur at any chosen point in time as follows:

Let $F_o$ be the initial installation tension desired on a roof bolt characterized by an average tension decay curve (A in FIG. 1). Let P be the adjustment factor (e.g. 0.80, 1.20, etc.) to be multiplied by $F_o$, to compute the desired installation tension on roof bolts characterized by tension decay curves different from A. Let $T_c$ be the desired time at which nominal convergence occurs, as indicated by X in FIG. 1. Let $F_c$ be the nominal tension remaining on all bolts at time $T_c$. The tension decay curves shown in FIG. 1 are expressed as: $T=K_1 F^{-K2}$, Where T is time subsequent to installation of the bolt under consideration, F is the bolt tension at time T, and $K_1$ and $K_2$ are constants so that $K_2$ determines the slope of the decay curve and is dependent on the characteristics of the rock immediately surrounding the anchor. Using the adjustment factor, the general equation describing the initial conditions at installation becomes:

$$T_o=K_1(PF_o)^{-K2}$$

where $T_o$ is the installation time. And since at convergence time $T_c$:

$$T_c=K_1F_c^{-K2}$$

$$PF_o/F_c=[T_c/T_o]^{1/K2} \text{ and}$$

$$p=[F_c/F_o][T_c/10^{-4}]^{1/K2}$$

which now defines the necessary initial tension adjustment factor P, in terms of convergence conditions $F_c$ and $T_c$ and tension decay rate exponent $K_2$, which is dependent on the rock immediately surrounding a particular anchor.

It has been observed that roof bolts sometimes reverse the trend of tension decay, and at some time after installation actually experience an increase in tension. Such increase in tension is due to the opening of bed separations and occasionally due to swelling of the rock strata in the zone spanned by the length of the roof bolt experiencing the tension increase. Both opening of bed separations and swelling of rock are always undesirable and will be reduced by application of the present method to reduce bolt tension variability.

The method described to reduce bolt tension variability may be extended very advantageously to determine to a high degree of precision the amount of bed separation occurring. Consider a particular roof bolt for which a particular tension decay rate was established at the time of its installation (applicable methods for accomplishing such establishment of tension decay rate will be described below). Let said tension decay rate be defined by:

$$T=K_1 F^{-K2},$$

so that:

$$F=[K_1/T]^{1/K2} \text{ and}$$

$$dF/dT=-[1/K_1 K_2][F]^{1+K2}$$

which now defines the time rate of change of bolt tension and hence creep rate of the rock as a function of bolt tension. Now since:

$$dF=(QE/L)dL$$

where Q is the cross sectional area of the shank of the roof bolt, L is the length of the roof bolt and E is the modulus of elasticity of the material of construction of the roof bolt, the total apparatus change in length of the bolt due to creep of the rock surrounding the anchor from the time of bolt installation to time T is equal to:

$$(\Delta L)_{cr}=\frac{L}{QEK_1K_2}\int_{T_o}^{T}[F]^{1+K2}\,dT$$

and the true change in length of the bolt from the time of bolt installation to time T is equal to:

$$(\Delta L)TR=(L/QE)(F_o-F)$$

The amount of bed separation which has taken place between time $T_o$ and T, then, is:

$$S_B=(\Delta L)_{CR}-(\Delta L)_{TR}$$

The integral in the expression for $(\Delta L)_{CR}$ may be evaluated if a few measurements of bolt tension have been made after the installation of the bolt, so that the shape of the bolt tension decay curve change has been established. This change is shown in FIG. 5, where curve H is the underlying tension decay characteristic established at the time of installation of the bolt and the curve I is obtained from actual measurement, the difference between H and I being due to opening of bed separations. If bolt tension increases as characterized by curve I are found on all bolts over a wide area in the mine, the tension increases are likely to be due to swelling of the rock due to moisture and the percent swell may be defined by:

$$P_s=(S_B/L)(100\%)$$

The underlying tension decay characteristic (H in FIG. 5) may be determined by measuring the compressive strength of the rock surrounding the bolt anchor during the process of installation as shown in my co-pending patent application, and deriving the creep characteristic of said rock by inference from said compressive strength measurement. The tension decay characteristic may also be measured directly by measurement of bolt tension remaining after a brief interval has elapsed following initial installation of the roof bolt. Scrutiny of FIG. 1 discloses that a very brief interval (p.e. 0.003 hour or 11 seconds) suffices to determine described tension decay characteristic with good accuracy because of the initial rapidity with which the bolt tension decays.

The method discovered thus comprises the following important steps to be performed as part of the installation process of each roof bolt:

1—Determine tension decay characteristic.

2—Tighten bolt to final tension, the exact value of the final tension being dependent on the value of the tension decay characteristic found in Step 1.

By performing the third step of checking bolt tension at suitable longer intervals after bolt installation time, numerical values may be derived for magnitude and location of bed separations taking place in the roof strata.

It is clear that numerous equivalent means can be designed to implement the method just described. A preferred embodiment of such means is set forth below in connection with FIGS. 6–9. The parameter of tension in the roof bolt is determined by inference from torque applied to the head of the roof bolt, since such torque is much more easily measurable and controllable using conventional equipment or modifications of conventional equipment than the bolt tension itself. To make such a substitution of bolt head torque for bolt tension practical for the purposes of this application, it is necessary that the relationship between bolt tension and bolt torque be dependable. A sufficiently dependable relationship in this respect can be created, if the following two conditions are observed:

1—the roof bolt threads are lubricated prior to roof bolt installation.

2—the thrust exerted on the roof bolt head during the roof bolt tensioning process is controlled and particularly maintained at a suitably low value, for example, by using the method described in my co-pending application.

The machine used to install and tighten the roof bolts must be equipped with means to accurately determine the torque applied to the roof bolt head. Means for accomplishing such torque measurement and control are available from prior art in this field, using electric, hydraulic or pneumatic techniques. Detailed means for obtaining a pneumatic signal proportional to torque output has been described in my co-pending patent application.

The process of decreasing time dependent variability in roof bolt tension can be made to proceed in two different ways:

1—A pneumatic signal can be generated, of which the pressure is a function of compressive strength of the rock immediately surrounding the rock bolt anchor. This signal may be entered into a function-generating pneumatic circuit, which results in a pneumatic output signal of a pressure proportional in magnitude to the desired final installation torque of the roof bolt.

2—The slope of the roof bolt tension (or torque) decay curve may be determined directly by measurement of tension (torque) remaining in the roof bolt a short period (p.e. 11 seconds) after attainment of a fixed initial tension (torque) in the roof bolt.

The determination of the necessary final installation torque based on the results of a rock compressive strength measurement is applicable in cases where the lithology encountered in the mine roof is always of the same type (e.g. sandstone), so that differences in compressive strength may serve to represent with reasonable accuracy the particular characteristics of the particular rock at a particular anchor site, including the creep characteristics. However, determination of necessary final installation torque based on the results of a direct bolt tension decay measurement has more general application, since it is independent from an assumption of relationship between compressive strength and creep rate. For this reason the latter means is described below in detail.

Figure 6:
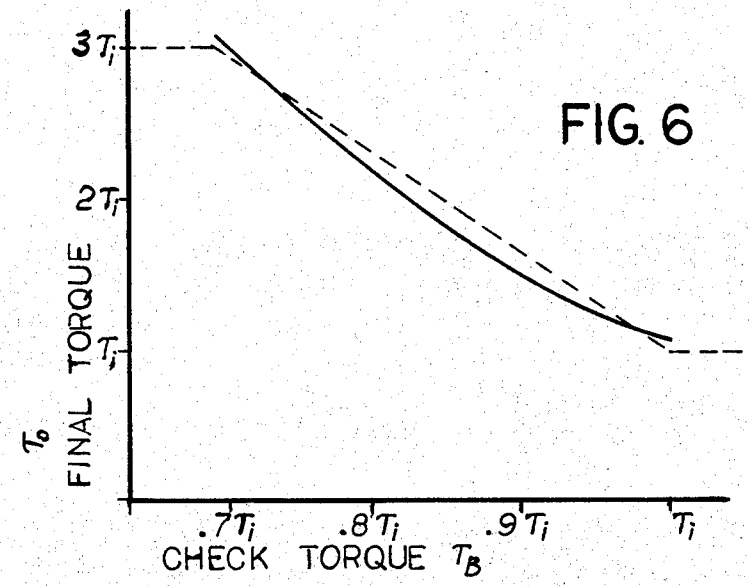
FIG. 6, a graphical representation showing a typical relationship between roof bolt head torque after an initial standard torque has been set on a roof bolt, and the subsequent final installation torque necessary on the roof bolt to obtain convergence of roof bolt tensions two hours later.

Let each roof bolt be tightened to an initial torque $\tau_i$. Then let a brief measured period elapse (say 11 seconds). Then check the torque remaining on the roof bolt head in terms of $\tau_i$. Using the factor P as defined previously for a particular convergence time $T_c$ and a particular torque check time lapse $T_B$ (11 seconds in the example just given), the desired final installation torque $\tau_o$ may be calculated for each value of check torque at time $T_B$. Such calculated sets of torque values may be plotted to depict the general relationship. A typical curve obtained by such procedure is depicted in FIG. 6 by the solid curve. The torque value to which all roof bolts installed under the conditions represented by FIG. 6 will converge two hours after installation time is approximately 1.1 $\tau_i$.

Figure 7:
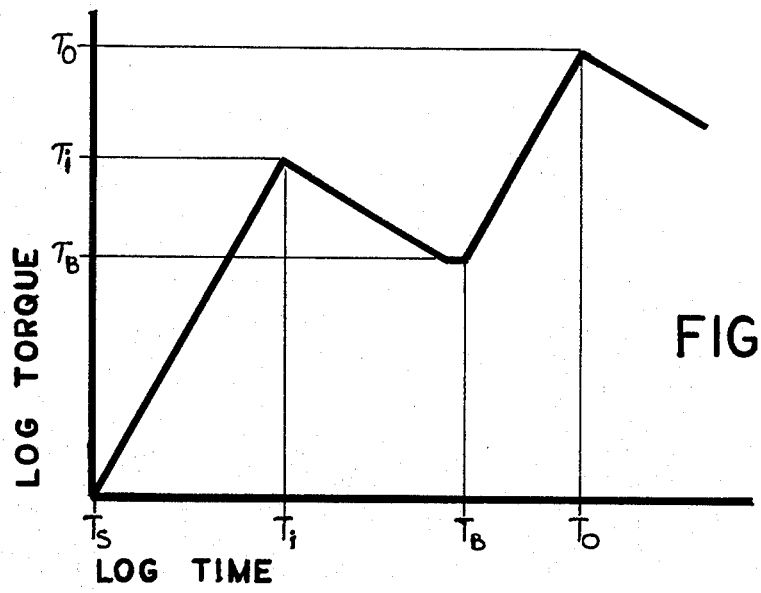
FIG. 7, a graphical representation showing the relationship between roof bolt head torque and time during an installation procedure.

FIG. 7 is included to further clarify the sequence of events, and shows how roof bolt head torque builds up during the installation sequence from $T_s$ (time at which torque begins to build) to $T_o$ (time at which bolt installation is completed). Typically ($T_o$-$T_s$) is on the order of 15 seconds. The sequence illustrated takes place completely automatically. Torque output to the roof bolt head is sensed in the form of a reaction force using means available from prior art. Torque is allowed by build to $\tau_i$, as the machine tensions the roof bolt by rotating the roof bolt head.

When the torque sensor means indicates a value of $\tau_i$, rotation of the roof bolt head is stopped and the roof bolt torque begins to drop in exponential fashion. At the same time a pneumatic timer, available from the prior art, such as Model No. R-331, manufactured by Clippard Instrument Laboratory, Inc. of Cincinnati, Ohio, is started. Anchorage quality may be determined while torque is building to $\tau_i$, using the method and means disclosed in my previously mentioned co-pending patent application.

The pneumatic timer, started at time $T_i$, times out at $T_B$, initiating a torque check on the roof bolt head. The torque check is accomplished by injecting a small, measured amount of hydraulic oil into the hydraulic motor which drives the bolt head rotation drive. Such exact volume of hydraulic oil may be obtained by discharging the oil contained in a small hydraulic cylinder. Forcing such an exactly measured quantity of oil through the hydraulic motor, causes an exact amount of rotation of the hydraulic motor, in turn causing an exact amount of roof bolt head rotation. The intent is to produce a discernible rotation at the bolt head, yet not so much as to produce a measurable increase in roof bolt tension. 3° of rotation of the roof bolt head has been used as a design basis.

The roof bolt head torque value obtained in the torque checking procedure just described is entered as input into a function-generating circuit which produces an output relates to the described input by a function similar to that shown in FIG. 6. The machine subsequently initiates roof bolt head rotation, causing the roof bolt tension (and torque) to increase. When the roof bolt head torque has reached a value of $\tau_o$, shown in FIG. 6, as defined by the output from the function-generating circuit just described, the machine turns off and the roof bolt installation is completed.

The particular implementation of the invention just described requires the following capability means operating in concert: means to drive the roof bolt head in rotation; means to sense roof bolt head torque; means to maintain roof bolt head torque—roof bolt tension relationship; means to stop roof bolt head rotation when torque $\tau_i$ is reached; means to time a standard period ($T_B$-$T_i$); means to check roof bolt head torque $\tau_B$ remaining at time $T_B$; means to generate a signal related to roof bolt head torque $\tau_B$; means to restart the roof bolt head rotation after completion of the measurement of $T_B$; and means to stop the roof bolt head rotation when the roof bolt head torque has attained a value of $\tau_o$ as determined from the value of $\tau_B$.

It is clear that one of the central aspects of the means is the capability to generate a function as defined by the graph shown in FIG. 6. Several different means can be devised to accomplish generation of such a function, including electric means and pneumatic means. In keeping with a preference for pneumatic means, a preferred arrangement utilizing pneumatic means is described to obtain the desired function generation. The arrangement generates a linear approximation, indicated by the dashed curve in FIG. 6, of the desired nonlinear relationship indicated by the solid curve in FIG. 6. The horizontal portions of the dashed curve impose practical limits on the system and define the normal operating range.

Figure 8:
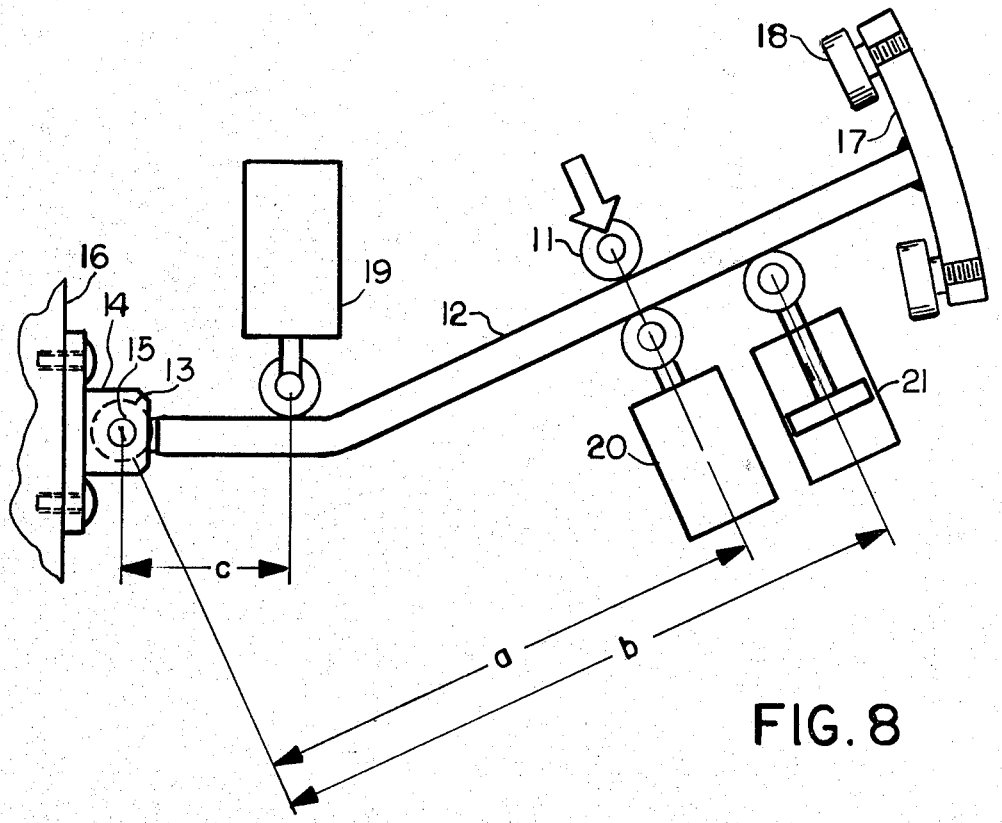
FIG. 8, a detailed view of the device for generating pneumatic signals for implementation of a roof bolt installation.

FIG. 8 shows a device used to generate the necessary pneumatic signals. A force proportional to torque applied to the roof bolt head is obtained by means available from prior art. The force is applied to the roller means 11 in FIG. 8 in the direction of the arrow in FIG. 8. Thus, the force proportional to the roof bolt head torque is permitted to act on a beam 12 in perpendicular fashion through roller means 11. Beam 12 is equipped at one end with an eye member 13 which in turn is rotatably pinned to a clevis member 14 with a pin member 15. Clevis member 14 is solidly fastened to machine frame 16. It is seen that clevis member 14 and eye member 13 together with pin member 15 allow beam 12 to be hinged back and forth coplanar with the direction of the arrow in FIG. 8. The end of beam 12 opposite to the end which terminates in eye 13 has a cross beam 17 fastened thereto. Cross beam 17 runs in a direction also coplanar with the direction indicated by the arrow in FIG. 8. Each end of cross beam 17 has a roller 18 fastened thereto. The rollers 18 confine the described hinging motion of beam 12 about pin member 15 to the direction coplanar with the direction indicated by the arrow in FIG. 8, because rollers 18 roll against upper and lower tracks (not shown) appropriate for described confining purpose.

Further positioned in combination with beam 12 are plunger operated air pressure regulators 19 and 20 and air cylinder 21. The plunger operated air pressure regulators are similar to Model No. 10-R, manufactured by Fairchild Corp. of Winston-Salem, N.C. The arrangement is such that application of the reaction force proportional to torque output to the roof belt head at roller 11 results in clockwise movement of beam 12 as shown in FIG. 8, causing a proportional depression of the plunger of air regulator 20, in turn causing a proportional increase in air pressure output (not shown) from air regulator 20. When the plunger of air regulator 20 is depressed, the plunger of air regulator 19 is completely extended and air pressure output from air regulator 19 is zero. By applying air pressure to air cylinder 21, beam 12 in induced to move in the anti-clockwise direction as shown in FIG. 8, and the effect of reaction force application by roller 11 is proportionately decreased. Moment arms about pin 15, applicable to air regulators 19, 20, and cylinder 21 are shown in FIG. 8 as c, a, and b, respectively. The moment arm about pin 15 applicable to roller 11 is also indicated by "a" in FIG. 8.

The arrangement as described can be used to adjust the pressure ranges of the air pressure regulators used. This is an important feature, since in typical operation the usable pressure range of the air regulators is limited to 10–100 psi. An example will help illustrate how the combination shown in FIG. 8 can be used to good advantage. Assume the reaction force at roller 11 directly represents torque output to the roof bolt head (i.e. 1 lb. at roller 11 represents 1 lb-ft of torque output). During the first phase of the installation cycle, when initial roof bolt torque is built (p.e. 130 lb-ft), air cylinder 21 has no pressure and the full reaction force available at roller 11 is exerted on the plunger of air pressure regulator 20. Under the conditions cited, 130 lb-ft of torque at the roof bolt head results in an output of 83 psi from regulator 20, and 0 from regulator 19. During the second phase of the installation cycle, that of checking decay of torque at the roof bolt head after a brief time lapse, air pressure is applied to the cylinder 21.

By appropriate sizing of components, range compression and expansion may be accomplished. If, for example, $c/a=0.32$, $a/b=0.80$, the bore size of cylinder 21 is 1.5" and 60 psi air pressure is applied to cylinder 21, a reaction force of 90 lbs at roller 11 results in an air pressure output of 80 psi from regulator 19. A reaction force of 120 lbs at roller 11 results in an air pressure output of 20 psi from regulator 19. In between the values just listed, force applied at roller 11 and air pressure output from regulator 19 are linearly related. The reason for the inverted relationship is clear: a lower force at roller 11 during this phase of the process implies a faster roof bolt torque decay rate and therefore requires a higher final installation torque. The output from regulator 19 is trapped at this stage to serve as reference for the final phase of the installation cycle. Details of this trapping of the signal are provided below.

If desired, varying relationships between force at roller 11 and output from regulator 19 may be obtained by varying the ratio c/a as well as the air pressure in cylinder 21. A convenient means of varying the ratio c/a is obtained by executing clevis member 14 in such a way that it may be screwed closer to or farther from frame 16. This can be easily accomplished with a single locking screw adjustment. Since regulators 19, 20 and force application roller 11 are fastened to frame 16, the adjustment described has the effect of changing the ratio of c/a. During the third and final phase of the installation cycle, that of increasing roof bolt torque to the desired final value, air pressure on the cylinder 21 is changed. For the construction and conditions described, applying a pressure of 49 psi to the cylinder results in an output from regulator 20 of 20 psi for a reaction force at roller 11 of 150 lbs and an output from regulator 20 of 80 psi for a reaction force at roller 11 of 350 lbs. Thus, the combination described is capable of providing a final installation torque on the roof bolt according to the relationship defined by the dotted line in FIG. 6.

Figure 9:
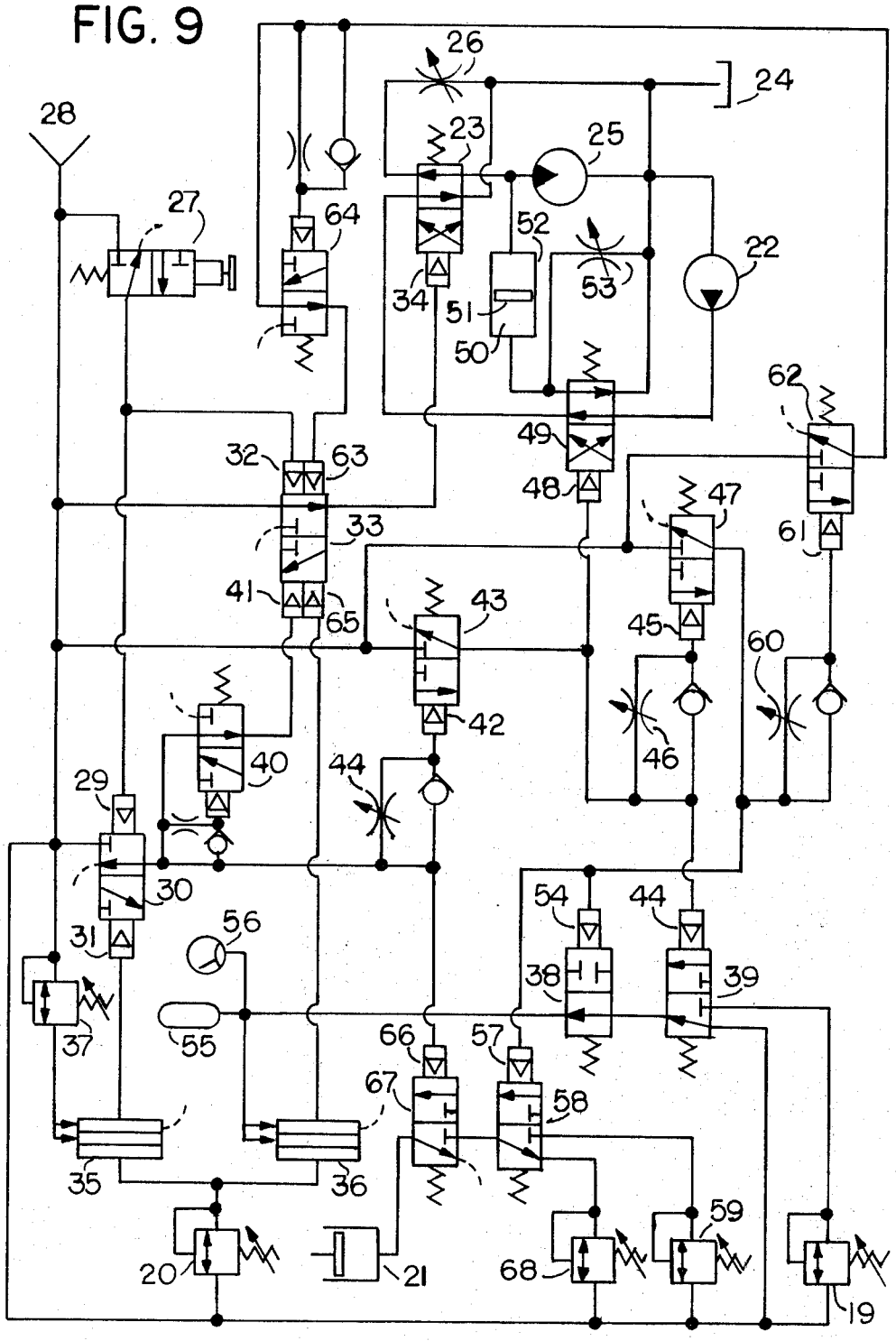
FIG. 9, a pneumatic flow diagram showing means to cause the pneumatic signals generated by the device shown in FIG. 8 to actuate roof bolt installation machinery to obtain roof bolt tension convergence.

The diagram shown in FIG. 9 indicates how the air pressures generated by air pressure regulators 19, 20 are used to control the installation process as desired. Prior to the bolt installation cycle, hydraulic pump 22 simply recirculates hydraulic fluid through valve 23 back to the hydraulic tank 24. Rotation motor 25 is short circuited through needle valve 26 and does not run. When cycle start valve 27 is pushed, pressurized air is admitted from source 28 to pilot 29 of double piloted valve 30. Since valve 30 is not spring loaded, it remains in the position dictated by pilot 29 until pilot 31 is pressurized, even if pressure is removed from pilot 29. Valve 30 then exhausts any pressurized pilots which have remained trapped from the previous bolt installation cycle. Pressurized air from valve 27 is similarly applied to pilot 32 of valve 33, causing it to shift accordingly. Again, valve 33 is not spring loaded, so that it remains in the position dictated by pilot 32 until an opposite pilot is pressurized. Valve 33 then allows air pressure to be applied from source 28 to pilot 34 of valve 23, thus shifting valve 23 and applying hydraulic pressure to rotation motor 25, causing the motor to begin rotating the roof bolt head. This increases roof bolt tension and roof bolt head torque.

The arrangement described in the diagram of FIG. 8 causes air pressure regulator 20 to gradually deliver an increased pressure to trip cells 35 and 36, this pressure being proportional to roof bolt head torque as discussed previously in the description of the diagram shown in FIG. 8. Trip cells 35 and 36 are available commercially, as exemplified by Model 1044 manufactured by Northeast Fluidics, Inc., a division of Clippard Instrument Laboratory, Inc., Cincinnati, Ohio. These trip cells each contain a diaphragm to one side of which a set, but adjustable, reference pressure is applied. The pressure output of air pressure regulator 20 is applied to the other side of the diaphragms. When the pressure output of air pressure regulator 20 reaches a value equal to or higher than the reference pressure set on one of the trip cells, an air signal output appears at the output port of the same trip cell. Trip cell 36 has full line pressure (p.e. 100 psi) applied as reference through open valves 33 and 39. Trip cell 35 has a lower reference pressure applied by pressure regulator 37.

As roof bolt head torque begins to build up, the pressure output of pressure regulator 20 first reaches the value set on trip cell 35, which then furnishes an output signal and pressurizes pilot 31 of valve 30. Valve 30 shifts and applies pressure through pulse valve 40 to pilot 41 of valve 33. Valve 33 shifts, exhausting pilot 34 of valve 23, which in turn stops the rotation motor 25. Because of needle valve 26, motor 25 is unlocked and roof bolt head torque is permitted to decay at the rate determined by the rock surrounding the roof bolt anchor. Because of the presence of pulse valve 40, pilot 41 is again exhausted immediately after valve 33 has shifted. Valve 30 also supplies pressure to pilot 42 of timing valve 43 through restriction 44. Because of restriction 44, pressure build up in pilot 42 is slow and shifting of valve 43 is delayed.

Finally, valve 30 also supplies pressure to pilot 66 of valve 67, causing valve 67 to shift and pressurize cylinder 21, the output of regulator 20 therefore drops to zero. The pressure now set on cylinder 21 is determined by air pressure regulator 68. When pressure in pilot 42 is sufficient to shift valve 43, valve 43 supplies pressure to pilot 44 of valve 39, thus connecting the output of regulator 19, as reference to trip cell 36. At the same time, valve 43 supplies air to pilot 45 of valve 47 through restriction 46. Restriction 46 causes another time delay before valve 47 shifts. Finally, valve 43 also pressurizes pilot 48 of valve 49. When valve 49 shifts, hydraulic pressure is applied to side 50 of piston 51 in hydraulic cylinder 52. The piston travels upward in FIG. 9, forcing hydraulic fluid through motor 25 and causing motor 25 to rotate.

The speed of rotation depends on the ratio of restrictions 26 and 53. The amount of rotation depends on the volume of cylinder 52 as well as on the ratio of restrictions 26 and 53. Parameters 26, 52 and 53 are adjusted to obtain a rotation speed of 5 to 10 RPM and a roof bolt head rotation angle of 2° to 4° before the stroke of cylinder 52 is used up. When the stroke of cylinder 52 is used up, motor 25 stops again. Meanwhile, regulator 19 furnishes a pressure reference level to trip cell 36 related to roof bolt head torque measured during the 2° to 4° rotation just mentioned, by the function shown in the diagram of FIG. 6; p.e. reference pressure is 80 psi for a roof bolt head torque of 90 lb-ft, and reference pressure is 20 psi for a roof bolt head torque of 120 lb-ft. Restriction 46 is adjusted so that valve 47 shifts just as cylinder 52 completes its stroke. When valve 47 shifts, pressure is applied to pilot 54 of valve 38, closing valve 38 and trapping reference pressure to trip cell 36.

A small volume chamber 55 is provided to decrease sensitivity to small air leaks. Gauge 56 is provided to permit visual read-out of an analog of the bolt tension decay rate. Valve 47 also supplies air to pilot 57 of valve 58. When valve 58 then shifts, the pressure in cylinder 21 is changed to the value set on pressure regulator 59. Finally valve 47 supplies air through restriction 60 to pilot 61 of valve 62. Restriction 60 provides a small time delay before valve 62 shifts, during which time the pressure change in cylinder 21 is permitted to stabilize. When valve 62 shifts, pressure is briefly applied to pilot 63 of valve 33, through pulse valve 64. Valve 33 shifts again, energizing pilot 34 of valve 23 and turning the rotation motor on again. Torque is again built higher on the roof bolt head, causing an increase in pressure output from regulator 20, which is applied to the trip cells. When said pressure output from regulator 20 equals the trapped reference pressure on trip cell 36, an output is produced to pressurize pilot 65 of valve 33, turning valve 23 and hence motor 25 off again. Final desired torque has been reached on the roof bolt head and the circuit remains in the state just described until reset by pressing valve 27 for the next bolt cycle.

Controls necessary to use motor 25 to drill the roof bolt hole have not been shown. Such controls are obvious using known principles. Similarly, controls disclosed in my co-pending patent application concerning determination of anchorage quality can be readily added to the circuit shown in FIG. 9 to provide the combined capability of measuring anchorage quality and bolt tension decay rate, as well as decreasing time dependent bolt tension variability through appropriate installation bolt tension control.

It is apparent that the various devices described above and especially the devices embodying means to adjust installed roof bolt tension in such a manner as to decrease long term roof bolt tension variability due to differing rates of tension decay, can be executed in such a fashion that they can readily be inserted in series with an existing roof bolt tightening means, as well as made an integral part of said roof bolt tightening means. Also, the invention as described can be combined with various devices, such as means to automatically record the tension decay rate of each bolt installed, thus extending the utility of the invention.

While I have shown and described several embodiments in accordance with the present invention, it is obvious that the same is not limited thereto, but is susceptible to numerous changes and modifications as known to those skilled in the art, and I therefore do not wish to be limited to the details shown and described herein but intend to cover all such changes and modifications as are encompassed by the scope of the appended claims.

I claim:

1. A method for controlling long term uniformity of a parameter in a population of similar processes, where said processes are characterized by an exponential change of said parameter with time, the rate of said exponential change with time being randomly variable from one individual representative of said process to the next, the invention comprising the steps of:

identifying the exponential change rate of said exponentially changing parameter for each individual representative of said process;

determining the required initial value for said parameter to change to a particular value at a particular time in the future based on the previously identified exponential change rate for each individual representative of said process, said particular value of said parameter as well as said particular time in the future being the same for all individual representatives of said process; and adjusting the initial value for said parameter to the desired level for each individual representative of said process as determined in the previous step.

2. A method as in claim 1, characterized in that the process is that of existence in time of a tensioned, mechanically anchored roof bolt in a mine roof, each individual representative of said process being the existence in time of a separate roof bolt as described, the exponentially changing parameter in time being the decaying tension on said roof bolt.

3. A method as in claim 2, characterized in that the step of identification of the exponential change rate of roof bolt tension comprises the steps of:

installing the roof bolt at a standard, fixed, initial tension;

allowing lapse of a standard, fixed time period; and checking tension remaining on said roof bolt.

4. A method as in claim 2, characterized in that roof bolt tension is determined by inference from torque on the roof bolt head.

5. A method to determine the magnitude of disturbing influences which may become active during the lifetime of individual representatives of a process, said disturbing influences having the effect of causing departure of the instantaneous value of an exponentially time changing parameter in said process from the exponential change rate in time characteristic of said individual representative of said process, said method comprising the steps of:

identifying the exponential change rate of said exponentially changing parameter;

monitoring subsequent deviations from the exponentially changing path of said parameter as determined from the previous step; and relating said measured deviations to the magnitude of said disturbing influence causing said measured deviations.

6. A method as in claim 5, characterized in that the process is that of existence in time of a tensioned, mechanically anchored roof bolt in a mine roof, each individual representative of said process being the existence in time of a separate roof bolt as described, the exponentially changing parameter in time being the decaying tension on said roof bolt, the disturbing influences being roof rock swell and opening and closing of separations between roof rock strata.

7. A method as in claim 6, characterized in that roof bolt tension is determined by inference from torque on the roof bolt head.

* * * * *

UNITED STATES PATENT AND TRADEMARK OFFICE

CERTIFICATE OF CORRECTION

PATENT NO. : 4,352,600

DATED : October 5, 1982

INVENTOR(S) : Carel J. H. Brest Van Kempen

It is certified that error appears in the above-identified patent and that said Letters Patent is hereby corrected as shown below:

Column 5, lines 50 to 54, the formula should appear as follows:

$$(\Delta L)_{cr} = \frac{L}{QEK_1K_2} \int_{To}^{T} g(F,T)\, dT$$

Signed and Sealed this

Eleventh Day of January 1983

[SEAL]

Attest:

GERALD J. MOSSINGHOFF

Attesting Officer

Commissioner of Patents and Trademarks